US008460077B2

(12) United States Patent
Wardlow

(10) Patent No.: US 8,460,077 B2
(45) Date of Patent: Jun. 11, 2013

(54) TWO-PLAYER GAME OF SKILL WHERE EACH PLAYER TRIES TO PRESS WHILE THE OTHER PLAYER IS PRESSING

(76) Inventor: William Glenn Wardlow, Sunriver, OR (US)

( * ) Notice: Subject to any disclaimer, the term of this patent is extended or adjusted under 35 U.S.C. 154(b) by 291 days.

(21) Appl. No.: 12/484,239

(22) Filed: Jun. 14, 2009

(65) Prior Publication Data

US 2009/0318205 A1 Dec. 24, 2009

(51) Int. Cl.
*A63F 13/00* (2006.01)

(52) U.S. Cl.
USPC ..... 463/7; 463/36; 463/37

(58) Field of Classification Search
USPC ..... 463/29, 31–33, 1–6, 40–42, 7, 36–37
See application file for complete search history.

(56) References Cited

U.S. PATENT DOCUMENTS 4,261,563 A * 4/1981 Goldfarb ..... 463/7
4,359,220 A * 11/1982 Morrison et al. ..... 463/9

OTHER PUBLICATIONS

Super Simon Game Manual. Released 1979.*

* cited by examiner

*Primary Examiner* — Ronald Laneau
*Assistant Examiner* — Ross Williams

(57) ABSTRACT

A two-Player game comprising the steps of first determining whether or not a Player is Pressing his or her Actuator, and if so, changing the state of the Indicator(s) to show the first Player is Pressing. Second determining whether or not the opposing Player presses while the first Player is pressing, and, if so, awarding a point to the opposing Player and adding it to Memory. Third, after a point is scored, comparing the scoring Player's cumulative score stored in Memory with a predetermined number of points necessary to win. If the scoring Player has not reached the predetermined number of points necessary to win, Indicating a point scored and resuming the game. If the scoring Player has reached the predetermined number of points necessary to win, Indicating that the scoring Player has won.

2 Claims, 2 Drawing Sheets

TWO-PLAYER GAME OF SKILL WHERE EACH PLAYER TRIES TO PRESS WHILE THE OTHER PLAYER IS PRESSING

BACKGROUND

Field

This application relates to two-player games of skill, specifically those using actuators and indicators.

This application uses the following defined terms:

Actuator—a physical means of sending a signal to the device embodying the invention Actuators—more than one Actuator Pressed—the state of an Actuator while it is being activated by physical means Indicator(s)—one or more visually observable devices capable of changing state

DRAWINGS

DETAILED DESCRIPTION

Figure 1:
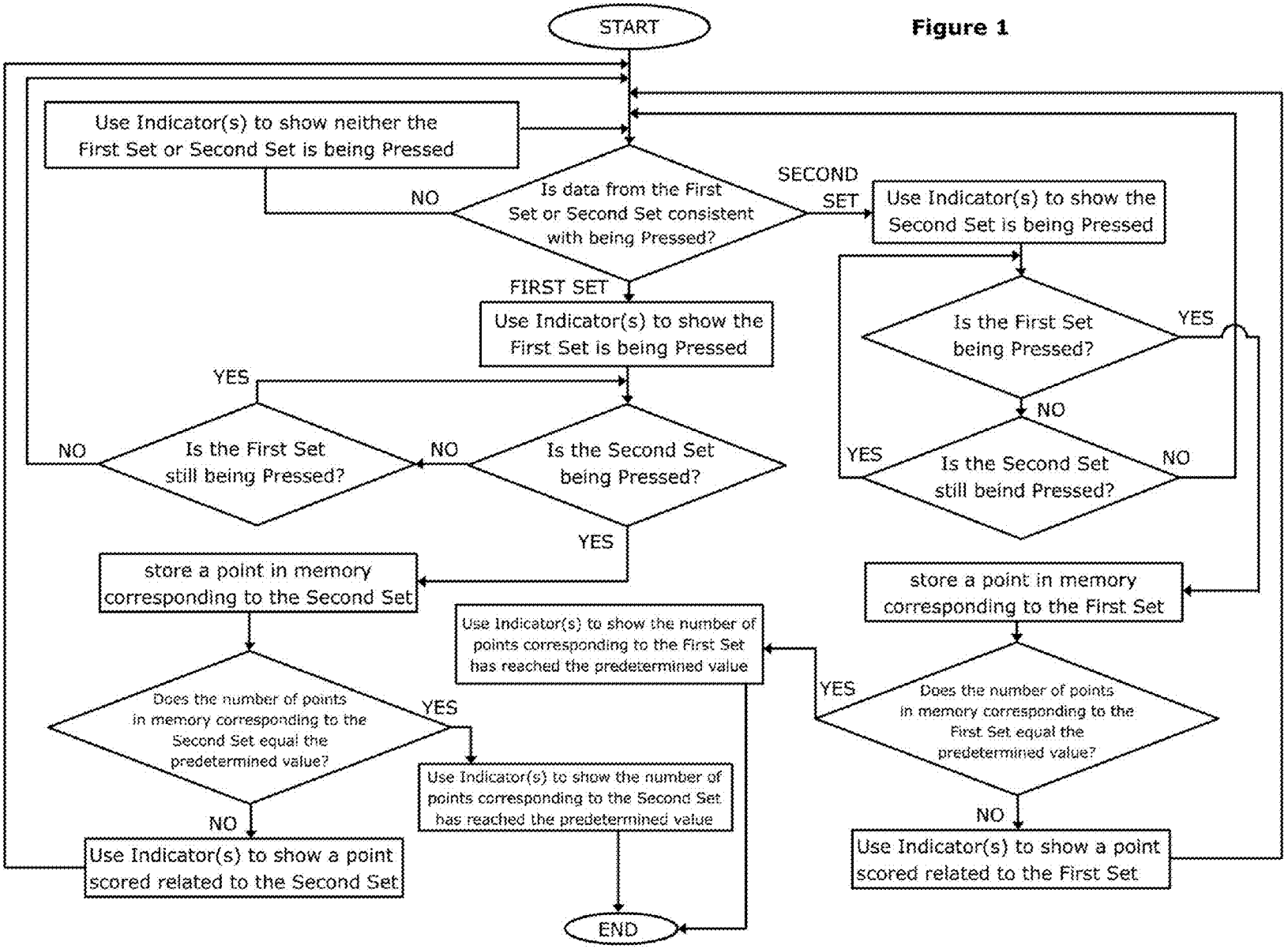
FIG. 1 is a flowchart showing the steps described in the First Embodiment.

The invention is both a process of operating a microcontroller to enable said microcontroller to facilitate a game comprising the steps of:

a. determining whether or not a signal from one of two distinct sets of Actuators (herein referred to as the First Set and Second Set) is consistent with being Pressed, and, if not, using Indicator(s) to show a first distinct state, and if so, using said Indicator(s) to show a second distinct state if said First Set is being Pressed or a third distinct state if said Second Set is being Pressed, b. and during the time said First Set is being Pressed and said second distinct state is being shown by said Indicator(s), determining whether said signal from said Second Set is consistent with being Pressed, and if so, storing a point in memory as part of a distinct cumulative score corresponding to said Second Set, and comparing said distinct cumulative score corresponding to said Second Set with a predetermined value, and if said predetermined value is not equal to said distinct cumulative score corresponding to said Second Set, using said Indicator(s) to show a fourth distinct state, and if said predetermined value is equal to said distinct cumulative score corresponding to said Second Set, using said Indicator(s) to show a fifth distinct state and ending the game, c. and during the time said Second Set is being Pressed and said third distinct state is being shown by said Indicator(s), determining whether said signal from said First Set is consistent with being Pressed, and if so, storing a point in memory as part of a distinct cumulative score corresponding to said First Set, and comparing said distinct cumulative score corresponding to said First Set with said predetermined value, and if said predetermined value is not equal to said distinct cumulative score corresponding to said Second Set, using said Indicator(s) to show a sixth distinct state, and if said predetermined value is equal to said distinct cumulative score corresponding to said First Set, using said Indicator(s) to show a seventh distinct state and ending the game, as well as a gaming machine comprising two distinct sets of Actuators, herein referred to as the First Set and Second Set; a signal input that receives said signal from said First Set and said Second Set; a microcontroller that analyzes said signals from said First Set and said Second Set and awards a point based on that analysis under certain circumstances described herein; a memory that stores points as part of distinct cumulative scores corresponding to said First Set and said Second Set; a microcontroller that compares the total of said distinct cumulative scores with a predetermined value; and a means of visually displaying at least seven distinct states using Indicator(s), whereby said gaming machine determines whether or not said signal from either said First Set or said Second Set is consistent with being Pressed and, if not, using said Indicator(s) to show a first distinct state, and if so, using said Indicator(s) to show a second distinct state if said First Set is being Pressed or to show a third distinct state if said Second Set is being Pressed, and during the time said First Set is being Pressed and said second distinct state is being shown by the Indicator(s) determining whether said signal from said Second Set is consistent with being Pressed, and if so, storing a point in memory as part of a distinct cumulative score corresponding to said Second Set, and comparing said distinct cumulative score corresponding to said Second Set with said predetermined value, and if said predetermined value has not been reached, using said Indicator(s) to show a fourth distinct state, and if said predetermined value has been reached, using said Indicator(s) to show a fifth distinct state and ending the game, and during the time said Second Set is being Pressed and said third distinct state is being shown by said Indicator(s) determining whether said signal from said First Set is consistent with being Pressed, and if so, storing a point in memory as part of a distinct cumulative score corresponding to said First Set, and comparing said distinct cumulative score corresponding to said First Set with said predetermined value, and if said predetermined value has not been reached, using said Indicator(s) to show a sixth distinct state, and if said predetermined value has been reached, using said Indicator(s) to show a seventh distinct state and ending the game.

Please refer to FIG. 1 which is a flowchart illustrating the steps of the Process.

Figure 2:
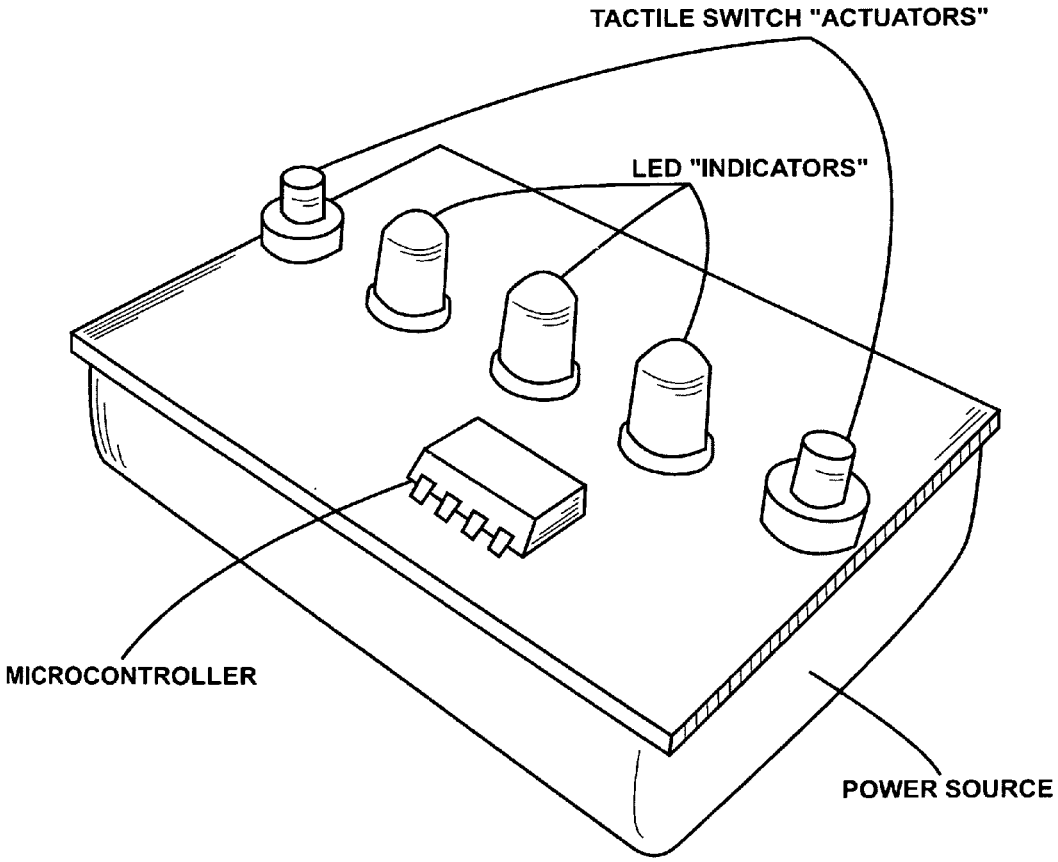
FIG. 2 is a photograph of the gaming device which plays a number of games, including the First Embodiment of the invention

The First Embodiment of the invention that is currently being sold by various retailers is a hand-held electronic game unit with two tactile switch buttons (one for each player) (the "Actuators"), an LED for each player (one green, one red) along with a 2-color red/green center LED (collectively the "Indicator(s)"), a microcontroller, and power source. See FIG. 2.

In the First Embodiment, the microcontroller is pre-programmed to accept signals from the Actuators, analyze said signals, and display information using the Indicator(s). The steps involved in the microcontroller program are illustrated in FIG. 1.

In the First Embodiment, each of the two players in the game is assigned an Actuator. The object of the game is for each player to try to press his or her Actuator when the other player is already pressing, thereby scoring a point. Each player's LED indicator is only on while pressing his or her Actuator. A point is indicated by flashing the LED Indicators that correspond to the color of the scoring Player.

In the First Embodiment, the microcontroller determines whether a point has been scored and by whom, and keeps track of each player's cumulative score in memory. When one player's score reaches a predetermined value, the center LED Indicator turns solid and the winning Player's LED indicator flashes.

Although the First Embodiment uses the aforementioned design, the invention is equally well-suited to countless other embodiments. One could easily utilize Actuators consisting of touch-sensitive switches, light sensors, wireless controls, or any other type of physical means of control. The invention is equally well-suited to countless other types of Indicator(s) such as LCD screens, or any type of electrical or mechanical apparatus that is capable of being seen by the Players and showing at least seven distinct states.

Similarly, there are countless different methods of visually indicating the various states of the game. Those in the First Embodiment were chosen for their cost.

The steps in FIG. 1 are shown in their approximate order, but certain steps can precede different steps without altering the fundamental game. For example, the box that says "Use Indicator(s) to show neither the First Set or Second Set is being Pressed" could be the first step in the game, and the diamond which asks "Is the First Set still being Pressed?" could loop back to the box which says "Use Indicator(s) to show the First Set is being Pressed" following a YES, however FIG. 1 attempts to minimize redundancies and streamline the flow.

Additional embodiments that are planned include, but are in no way limited to, the following:

Mobile Phone application
Internet application
Video game
Electro-Mechanical toy

The invention claimed is:

1. A process of operating a microcontroller to enable said microcontroller to facilitate a game comprising the steps of:

a. the microcontroller determining whether or not a signal from one of two distinct sets of Actuators, herein referred to as the First Set and Second Set, is consistent with being Pressed, and, if not, using Indicators to show a first distinct state, and if so, using said Indicators to show a second distinct state if said First Set is being Pressed or a third distinct state if said Second Set is being Pressed, b. and during the time said First Set is being Pressed and said second distinct state is being shown by said Indicators, determining whether said signal from said Second Set is consistent with being Pressed, and if so, storing a point in memory as part of a distinct cumulative score corresponding to said Second Set, and comparing said distinct cumulative score corresponding to said Second Set with a predetermined value, and if said predetermined value is not equal to said distinct cumulative score corresponding to said Second Set, using said Indicators to show a fourth distinct state, and if said predetermined value is equal to said distinct cumulative score corresponding to said Second Set, using said Indicators to show a fifth distinct state and ending the game, c. and during the time said Second Set is being Pressed and said third distinct state is being shown by said Indicators, determining whether said signal from said First Set is consistent with being Pressed, and if so, storing a point in memory as part of a distinct cumulative score corresponding to said First Set, and comparing said distinct cumulative score corresponding to said First Set with said predetermined value, and if said predetermined value is not equal to said distinct cumulative score corresponding to said Second Set, using said Indicators to show a sixth distinct state, and if said predetermined value is equal to said distinct cumulative score corresponding to said First Set, using said Indicators to show a seventh distinct state and ending the game.

2. A gaming machine, comprising:

a. two distinct sets of Actuators, herein referred to as the First Set and Second Set, b. signal inputs that receive said signals from said First Set and said Second Set, c. a microcontroller that analyzes said signals from said First Set and said Second Set and awards a point based on that analysis under certain circumstances described herein, d. a memory that stores points as part of distinct cumulative scores corresponding to said First Set and said Second Set, e. a microcontroller that compares the total of said distinct cumulative scores with a predetermined value, f. a means of visually displaying at least seven distinct states using Indicators, whereby said gaming machine determines whether or not said sig from either said First Set or said Second Set is consistent with being Pressed and, if not, using said Indicators to show a first distinct state, and if so, using said Indicators to show a second distinct state if said First Set is being Pressed or to show a third distinct state if said Second Set is being Pressed, and during the time said First Set is being Pressed and said second distinct state is being shown by the Indicators determining whether said signal from said Second Set is consistent with being Pressed, and if so, storing a point in memory as part of a distinct cumulative score corresponding to said Second Set, and comparing said distinct cumulative score corresponding to said Second Set with said predetermined value, and if said predetermined value has not been reached, using said Indicators to show a fourth distinct state, and if said predetermined value has been reached, using said Indicators to show a fifth distinct state and ending the game, and during the time said Second Set is being Pressed and said third distinct state is being shown by said Indicators determining whether said signal from said First Set is consistent with being Pressed, and if so, storing a point in memory as part of a distinct cumulative score corresponding to said First Set, and comparing said distinct cumulative score corresponding to said First Set with said predetermined value, and if said predetermined value has not been reached, using said Indicators to show a sixth distinct state, and if said predetermined value has been reached, using said Indicators to show a seventh distinct state and ending the game.

* * * * *